US007749572B2

(12) United States Patent
Kitamura

(10) Patent No.: US 7,749,572 B2
(45) Date of Patent: Jul. 6, 2010

(54) LESS IRRITANT OR INFLAMMATORY GLOVE AND METHOD FOR PRODUCING THE SAME

(76) Inventor: Keikichi Kitamura, No. 15-4, 5-Chome, Ryoke, Urawa-Ku, Saitama-Ken, Saitama-Shi (JP)

( * ) Notice: Subject to any disclaimer, the term of this patent is extended or adjusted under 35 U.S.C. 154(b) by 1114 days.

(21) Appl. No.: 11/259,103

(22) Filed: Oct. 27, 2005

(65) Prior Publication Data

US 2006/0073274 A1 Apr. 6, 2006

Related U.S. Application Data

(62) Division of application No. 10/819,112, filed on Apr. 7, 2004, now Pat. No. 7,341,962.

(30) Foreign Application Priority Data

Oct. 30, 2003 (JP) ..... 2003-370837

(51) Int. Cl.
*B05D 1/18* (2006.01)

(52) U.S. Cl. ..... 427/430.1; 427/2.1; 2/16

(58) Field of Classification Search ..... 427/430.1
See application file for complete search history.

(56) References Cited

U.S. PATENT DOCUMENTS

2002/0111431 A1* 8/2002 Kajiwara et al. ..... 525/162

FOREIGN PATENT DOCUMENTS

| | | | |
|---|---|---|---|
| JP | 62-6985 | | 1/1987 |
| JP | 4-4013 | | 1/1992 |
| JP | 5-13170 | | 2/1993 |
| JP | 6-42902 | | 6/1994 |
| JP | 7-3531 | | 1/1995 |
| JP | 2530096 | | 6/1996 |
| JP | 8-170218 | | 7/1996 |
| JP | 2677850 | | 7/1997 |
| JP | 10-1808 | | 1/1998 |
| JP | 10-259521 | | 9/1998 |
| JP | 11-335913 | | 12/1999 |
| JP | 2001303437 | A * | 10/2001 |
| JP | 2002-17823 | | 1/2002 |
| JP | 3087042 | | 4/2002 |
| JP | 2003213548 | A * | 7/2003 |

* cited by examiner

*Primary Examiner*—David Turocy
(74) *Attorney, Agent, or Firm*—Young & Thompson

(57) ABSTRACT

Provided is a less irritant or inflammatory glove in which irritation and inflammation are to be reduced when using the glove made from latex, nitrile, PVC, or the like in the field of medicine, physical and chemical research, industry, or the like by utilizing antipruritic and antiinflammatory effects of phthalocyanine, but not by reducing the contents of protein ingredients contained in a latex glove as in prior art. Phthalocyanine is used as a less irritant or inflammatory agent when wearing the glove. The phthalocyanine is mixed into a raw material for an inner glove, or mixed into a raw material of the glove, or mixed into a lubricant for wearing the glove, or mixed into a coating material applied to the inside surface of the glove, or adhered to a filling implanted on the inside surface of the glove.

2 Claims, No Drawings

LESS IRRITANT OR INFLAMMATORY GLOVE AND METHOD FOR PRODUCING THE SAME

CROSS REFERENCE TO RELATED APPLICATIONS

This application is a division of application Ser. No. 10/819,112, filed on Apr. 7, 2004, now U.S. Pat. No. 7,341, 962, the entire contents of which are hereby incorporated by reference.

BACKGROUND OF THE INVENTION

1. Field of the Invention

The present invention relates to a less irritant or inflammatory glove for reducing itching and irritation when using a glove made from latex, nitrile, PVC, or the like in a field of medicine, physics and chemistry, industry, or the like as well as a method for producing the same.

2. Background Art

In the fields of medicine, physical and chemical research, industry, or the like, gloves tailored to respective applications have heretofore been used. Such gloves are to be put on a hand for the purposes of hygiene, antifungus, hand protection, slip stopper, or the like. Examples of materials to be used in such gloves include latex such as natural rubber, synthetic rubber, or synthetic resin, nitrile rubber, and PVC (polyvinyl chloride).

In use of the above described gloves, allergodermia is a problem in which a nonrubber ingredient such as protein contained in natural rubber or a substance added thereto causes rash, itching, eczema, or the like on the hand; or protein contained in cornstarch powder used as lubricant for smoothly putting on or taking off a glove causes rash, itching, eczema, or the like in combination with sweat inside the glove.

Patent Documents 1 and 2 are conventional examples for preventing itching and irritation caused by wearing such latex gloves. Among them, "Flexible Rubber Product and Method for Producing Them," the invention of Patent Document 1, relates to a medical multi-layered glove formed of: a patient contact layer formed from aqueous natural rubber latex emulsion as a film; a wearer contact layer formed from aqueous emulsion containing an acryl copolymer and fluorocarbon telomer resin; and the above patient contact layer and the above wearer contact layer formed from aqueous emulsion containing natural rubber latex, polyurethane latex, poly (acrylamide/acrylic acid), and polyethylene oxide.

The invention of Patent Document 2, "Latex Glove," relates to a latex glove formed from deproteinized natural rubber characterized by containing 0.5 parts by weight or more of particulates having a group of —OH per 100 parts by weight of the above natural rubber.

Each invention of the above Patent Documents 1 and 2 is to reduce protein allergy by reducing a content of protein ingredients in a latex glove.

[Patent Document 1] JP Patent Publication (Kokai) No. 6-70942 A (1994) (pages 1 and 2)

[Patent Document 2] JP Patent Publication (Kokai) No. 11-81014 A (1999) (pages 1 and 2)

[Non-Patent Document 1] Japanese Pharmacology & Therapeutics, Life Science Publishing Co., Ltd., issued on Apr. 20, 1996, Vol. 24 No. 4, pages 132 to 135

SUMMARY OF THE INVENTION

At the same time, technologies for using phthalocyanine known as conventional dye or pigment as deodorant of fibers such as clothing, bedclothing, and rugs have been developed in new fields, focusing on the deodorant effect.

Moreover, as a possibility to use the phthalocyanine in other applications, the clinical results of the above Non-Patent Document 1 or the like recently have recently reported that phthalocyanine has antipruritic and antiinflammatory effects.

The content of the above Non-Patent Document 1 may be summarized as follows: "Histamine and serotonin are identified in causative agents that generate various symptoms of allergodermia, but it is well known that both are physiologically active amine and have an effect to cause itching and irritation to skin as one of their effects. Two types of general antihistamine and antiserotonin are currently used against these effects: (1) a type that causes antagonistic disorder by binding to histamine, serotonin, and receptors and (2) a type that control release of histamine and serotonin from mast cells. As described above, from clinical experience, we presumed the existence of an antihistamine effect by means of a third mechanism different from the two types and performed the following basic experiments to verify the possibility." As a result, "metal phthalocyanine octacarboxylic acid [metal=Fe, Co] can be said to be fully promising as novel antihistamine and antiserotonin agents having new control mechanisms."

The present invention has been made in consideration of the above circumstances and has an object to provide a less irritant or inflammatory glove for reducing itching and irritation when using a glove made from latex, nitrile, PVC, or the like in a field of medicine, physics and chemistry, industry, or the like as well as a method for producing the same, in which the reduction is realized not by reducing the content of protein ingredients contained in the latex glove as in prior art, but by utilizing antipruritic and antiinflammatory effects of phthalocyanine.

In order to achieve the above object, the invention is a less irritant or inflammatory glove wherein phthalocyanine is adhered to an inner glove that is knitted with cotton or synthetic resin yarn.

The invention is a method for producing a less-irritant or inflammatory glove wherein phthalocyanine is adhered to the glove by immersing an inner glove that is knitted with cotton or synthetic resin yarn in a phthalocyanine solution.

The invention is a method for producing a less irritant or inflammatory glove wherein an inner glove is knitted with yarn to which phthalocyanine is adhered by immersing cotton or synthetic resin yarn in a phthalocyanine solution.

The invention is a less irritant or inflammatory glove wherein phthalocyanine is mixed in cornstarch powder for use as lubricant when putting on the glove.

The invention is a less irritant or inflammatory glove wherein phthalocyanine cation bound to cellulose is adhered as lubricant when putting on the glove.

The invention is a less irritant or inflammatory glove wherein phthalocyanine is mixed in a coating material of the inside surface of the glove, the coating material being provided for smoothly putting on or taking off the glove.

The invention is a less irritant or inflammatory glove wherein phthalocyanine is mixed in a raw material of the glove made from natural rubber, synthetic rubber, or synthetic resin that is a raw material of gloves.

The invention is a method for producing a less irritant or inflammatory glove comprising the steps of: mixing phthalocyanine in a liquid of natural rubber, synthetic rubber, or synthetic resin that is a raw material of gloves; immersing a model of the glove in the liquid; and allowing the liquid that is adhered to the surface of the model to be vulcanized and coagulated.

Further, the invention is a less irritant or inflammatory glove wherein phthalocyanine is adhered to an implanted filling provided on the inside surface of the glove.

The less irritant or inflammatory glove of the present invention applies phthalocyanine for reducing itching and irritation of skin when wearing a glove made from latex, nitrile, PVC, or the like.

In the present invention, when embodying a less irritant or inflammatory gloves in which phthalocyanine is adhered to an inner glove that is knitted with cotton or synthetic resin yarn, the inner glove is worn inside a surgical latex glove. Since the inner glove contacts skin during use, phthalocyanine is adhered to the inner glove to allow phthalocyanine to contact skin, resulting in benefit for the wearer by reducing itching and irritation.

The glove in which phthalocyanine is adhered to the inner glove can be easily produced by a method for adhering the phthalocyanine to the inner glove knitted with cotton or synthetic resin yarn by immersing the inner glove in a phthalocyanine solution or a method for knitting the inner glove with yarn to which the phthalocyanine is adhered by immersing cotton or synthetic resin yarn in the phthalocyanine solution.

In the less irritant or inflammatory glove of the present invention, if phthalocyanine is mixed in cornstarch powder to be used as lubricant for the time of putting on the glove, the lubricant presents between the inside surface of the tightly fitted latex glove or the like and skin so that a motion of putting on or taking off the glove can be performed smoothly because of the particulate powder. Mixing phthalocyanine in the cornstarch powder to be used as lubricant allows phthalocyanine to contact skin, resulting in benefit for the wearer by reducing itching and irritation.

As such lubricant, the present invention does not use cornstarch powder but use powder in which phthalocyanine is cation bound to cellulose so that phthalocyanine contacts skin in the same manner as in the above, resulting in benefit for the wearer by reducing itching and irritation.

In the less irritant or inflammatory glove of the present invention, if phthalocyanine is mixed in a coating material on the inside surface of the glove, which is provided for smoothly putting on or taking off the glove, the phthalocyanine contained in the coating material contacts skin, resulting in benefit for the wearer by reducing itching and irritation.

In the less irritant or inflammatory glove of the present invention, if phthalocyanine is mixed in a raw material of the glove made from natural rubber, synthetic rubber, or synthetic resin that is a raw material of gloves, when wearing the glove, the phthalocyanine contained in the raw material directly contacts hand skin, resulting in benefit for the wearer by reducing itching and irritation.

Such a less irritant or inflammatory glove can be easily produced by a method comprising the steps of: mixing phthalocyanine in a liquid of natural rubber, synthetic rubber, or synthetic resin that is a raw material of gloves; immersing a model of the glove in the liquid; and allowing the liquid that is adhered to the surface of the model to be vulcanized and coagulated.

Further, in the less irritant or inflammatory glove of the present invention, if phthalocyanine is adhered to an implanted filling provided on the inside surface of the glove, when wearing the glove, the phthalocyanine that is adhered to the implanted filling provided on the glove contacts hand skin, resulting in benefit for the wearer by reducing itching and irritation. Further, a heavy PVC glove, a heavy nitrile glove, a natural rubber heavy glove, or the like is suitable as such a glove that is implanted a filling on the inside surface. The glove is most suitable for an application as an industrial glove.

DETAILED DESCRIPTION OF THE PREFERRED EMBODIMENTS

The examples of the present invention will now be described.

Phthalocyanine to be used in the present invention is an organic compound containing metal such as iron, sometimes referred to as metal phthalocyanine, have been used as dye, and known for a person skilled in the art as a substance having a deodorant effect. Among such phthalocyanine; metal phthalocyanine octacarboxylic acid [metal=Fe, Co], for example, can be referred to as one that is expected to have an effect of reducing itching and irritation, which is expected to be a new substance having new antihistamine and antiserotonin effects capable of reducing itching and irritation.

EXAMPLE 1

A less irritant or inflammatory glove of this example relates to an inner glove. It should be noted that an inner glove is a thin glove that is worn inside a surgical latex glove. The inner glove is knitted with cotton yarn, synthetic resin yarn such as polyester, or the like. In this example, phthalocyanine is adhered to the inner glove.

A method for adhering phthalocyanine to the inner glove can be performed by immersing the inner glove knitted with cotton or synthetic resin yarn such as polyester in a phthalocyanine solution so that the phthalocyanine is adhered to the inner glove.

The inner glove can be knitted by yarn to which the phthalocyanine is adhered by immersing cotton or synthetic resin yarn in a phthalocyanine solution.

EXAMPLE 2

A less irritant or inflammatory glove of this example relates to a glove made from natural rubber, synthetic rubber, or synthetic resin, to which lubricant for the time of putting on the glove is adhered. In this example, cornstarch powder used as such lubricant in admixture with phthalocyanine is adhered to the inside surface of the glove.

Alternatively, phthalocyanine cationically bound to cellulose is used as lubricant when putting on the glove, which is adhered to the inside surface of the glove made from natural rubber, synthetic rubber, or synthetic resin.

Further, other than applying lubricant to a reversed glove, a method for adhering the above lubricant to the inside surface of a glove may comprise immersing the glove that is reversed in a phthalocyanine solution followed by drying.

EXAMPLE 3

A less irritant or inflammatory glove of this example relates to a glove with a inside surface to which a coating material is applied in order to smoothly put on or take off the glove made from natural rubber, synthetic rubber, or synthetic resin. Urethane, polymers, or the like is usually used as such a coating material. In this example, such a coating material in admixture with phthalocyanine is used. The coating material is coated on the inside surface of the glove made from natural rubber, synthetic rubber, or synthetic resin.

EXAMPLE 4

A less irritant or inflammatory glove of this example is made from a raw material of gloves made from natural rubber, synthetic rubber, or synthetic resin in admixture with phthalocyanine.

A method for producing such a glove comprises the steps of: mixing phthalocyanine in a liquid of natural rubber, synthetic rubber, or synthetic resin that is a raw material of gloves; placing a model of the glove in the liquid; and allowing the liquid that has been attached to the surface of the model to be vulcanized and coagulated.

EXAMPLE 5

A less irritant or inflammatory glove of this example is one in which phthalocyanine is adhered to a filling provided on the inside surface of the glove. In order to provide the filling on the inside surface of the glove, the rubber surface that is a raw material of the glove is charged with positive ions and provided with a binding material, at the same time, phthalocyanine is impregnated in cotton that is formed to have uniform microlength as a raw material of an implanted filling, which is charged with negative ions to be adhered to the surface charged with positive ions in a condition in which filling is implanted.

In the above explanation, the present invention shows the feature as a less irritant or inflammatory glove. However, the less irritant or inflammatory effect of phthalocyanine can be also expected in its application to a fingerstall that is also worn on a finger within a range in which the above invention can be applied, for example, by mixing phthalocyanine into a raw material for the fingerstall or by mixing phthalocyanine into powder used as lubricant for putting on the fingerstall.

In the present invention, if an inner glove is processed with phthalocyanine, the inner glove can be utilized as a glove that is worn inside a surgery glove having a less irritant or inflammatory effect.

In the present invention, if phthalocyanine is mixed to lubricant for putting on a glove, the lubricant can be utilized as a lubricant that works to smoothly put on the glove made from natural rubber, synthetic rubber, or synthetic resin having adhesiveness to skin and that is provided with a less irritant or inflammatory effect.

In the present invention, if phthalocyanine is adhered to a coating material for smoothly putting on and taking off a glove on the inside surface of the glove, the glove can be utilized as a glove having the coating material thereon that is provided with a less irritant or inflammatory effect.

In the present invention, if phthalocyanine is mixed in a raw material of a glove made from natural rubber, synthetic rubber, or synthetic resin that is a raw material of gloves, even when wearing a glove of which raw material directly touches hand skin, the glove can be utilized as a surgery glove or a laboratory glove that is provided with a less irritant or inflammatory effect of phthalocyanine.

Moreover, in the present invention, if phthalocyanine is adhered to an implanted filling provided on the inside surface of a glove, the glove can be utilized as various heavy gloves for industry use.

What is claimed is:

1. A method for producing a less irritant or inflammatory glove comprising the steps of:

mixing phthalocyanine into a liquid which causes irritation and inflammation selected from group consisting of natural rubber, synthetic rubber and synthetic resin to form a liquid raw material for making gloves;

immersing a model of the glove in the liquid raw material so that the liquid raw material attaches to the surface of the model; and allowing the liquid raw material that has been attached to the surface of the model to be vulcanized and coagulated so as to form a glove provided with a less irritant or inflammatory effect from the phthalocyanine.

2. The method according to claim 1, wherein the liquid natural rubber or synthetic rubber.

* * * * *